US005697794A

United States Patent [19]

Mosquera

[11] Patent Number: 5,697,794

[45] Date of Patent: Dec. 16, 1997

[54] HIGH DENSITY CONNECTOR ASSEMBLY

[75] Inventor: Rene Augusto Mosquera, Laguna Niguel, Calif.

[73] Assignee: ITT Corporation, New York, N.Y.

[21] Appl. No.: 324,993

[22] Filed: Oct. 18, 1994

[51] Int. Cl.[6] ..... H01R 9/09

[52] U.S. Cl. ..... 439/67

[58] Field of Search ..... 439/62, 67, 496, 439/79, 80, 637

[56] References Cited

U.S. PATENT DOCUMENTS

| | | | |
|---|---|---|---|
| 3,082,398 | 3/1963 | Valach . | |
| 3,102,767 | 9/1963 | Schneck . | |
| 3,154,365 | 10/1964 | Crimmins . | |
| 3,319,216 | 5/1967 | McCullough . | |
| 3,486,159 | 12/1969 | Matthews | 439/496 X |
| 3,614,707 | 10/1971 | Kaufmann | 439/67 X |
| 3,922,054 | 11/1975 | Dechelette . | |
| 4,348,071 | 9/1982 | Hsieh . | |
| 4,552,420 | 11/1985 | Eigenbrode . | |
| 4,784,615 | 11/1988 | Teng-Hong | 439/496 OR |
| 4,802,866 | 2/1989 | Balzano et al. | 439/496 |
| 4,907,975 | 3/1990 | Dranchak et al. | 439/67 |
| 4,911,643 | 3/1990 | Perry et al. | 439/67 |
| 5,026,291 | 6/1991 | David | 439/67 |
| 5,044,980 | 9/1991 | Krumme et al. | 439/496 |
| 5,080,595 | 1/1992 | Mouissie | 439/67 |
| 5,163,835 | 11/1992 | Morlion et al. | 439/67 |
| 5,195,897 | 3/1993 | Kent et al. | 439/67 |
| 5,297,968 | 3/1994 | Johnson et al. | 439/67 |
| 5,316,486 | 5/1994 | Tanaka et al. | 439/62 |

*Primary Examiner*—P. Austin Bradley
*Assistant Examiner*—Daniel Wittels
*Attorney, Agent, or Firm*—Freilich Hornbacker Rosen

[57] ABSTRACT

A connector assembly which includes a circuit board (18, FIG. 2 and 28, FIG. 3), a connector housing (40, 140), and a pair of flat flexible circuits (20, 22 and 30, 32). The flat flexible circuits have front end portions (50, 52 and 190, 192), where the circuit conductors form two spaced rows of connector contacts, and the circuits have stacked rear portions (60, 62 and 154, 156) where the conductors of the two flat flexible circuits are staggered and soldered to a single row of circuit board traces (80, FIG. 6).

13 Claims, 4 Drawing Sheets

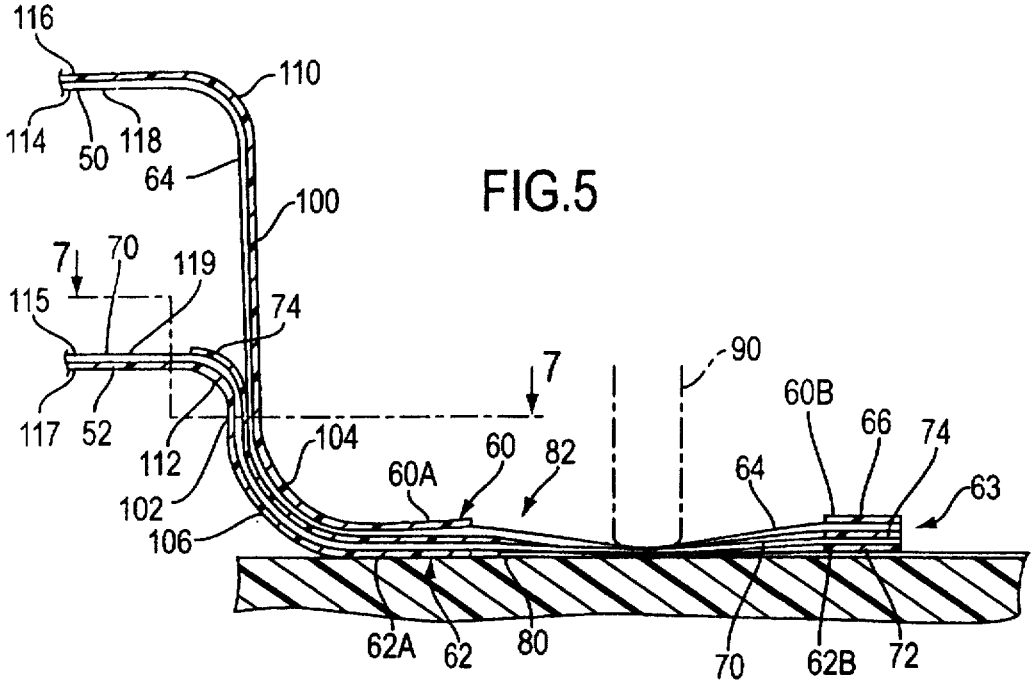
FIG.5
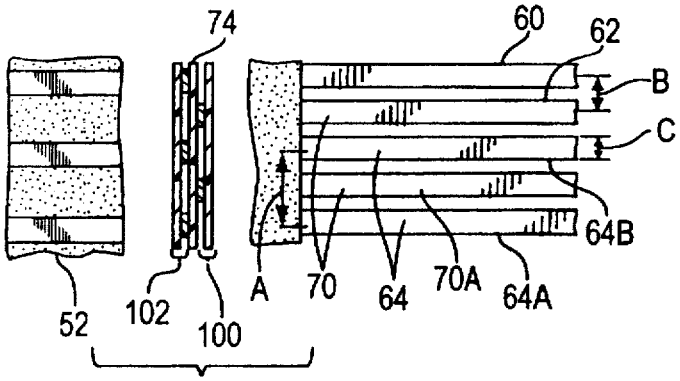
FIG. 7
FIG. 6
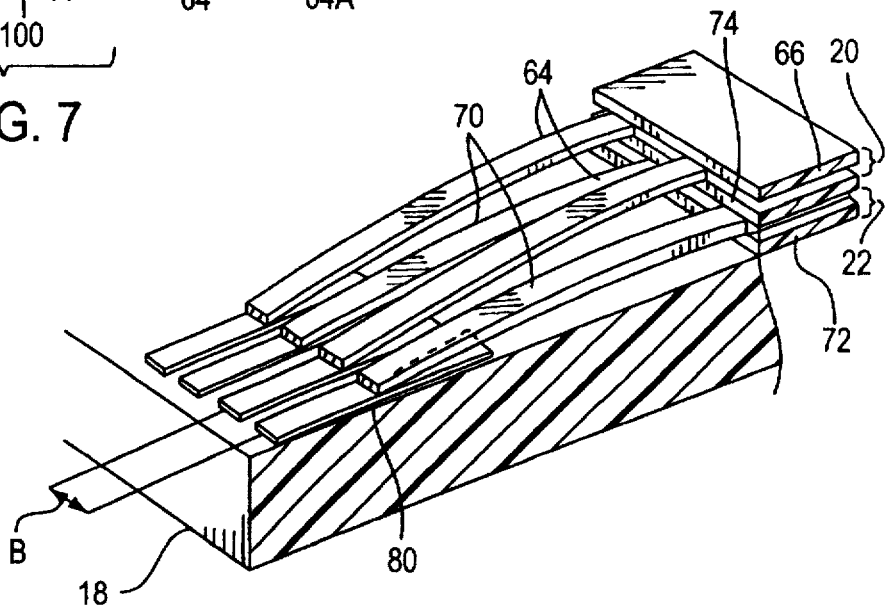

HIGH DENSITY CONNECTOR ASSEMBLY

BACKGROUND OF THE INVENTION:

Connectors are commonly constructed with two rows on contacts lying in spaced planes. In a receptacle connector, the two rows of contacts are mounted on spaced beams and have contacting locations facing each other, while in a plug connector the contacts are mounted on a central beam and have contacting locations facing away from each other. Where the contacts must be closely spaced apart along each row, they can be formed as the front end portions of conductors of a flat flexible circuit, with rear portions of the conductors soldered to traces on a circuit board. This generally involves the separate soldering of the conductors of each flat flexible circuit to a separate row of circuit board traces. The necessity of providing two rows of traces and soldering each circuit separately to a trace, increases the circuit board area required for a connector and increases manufacturing costs by requiring two solder connection areas. A connector with two rows of contact areas provided by two separate flat flexible circuits, but with the conductors of the circuit soldered to a single row of circuit board traces, would be of value.

SUMMARY OF THE INVENTION

In accordance with one embodiment of the present invention, a connector assembly is provided which includes two flat flexible circuits with front end portions lying in spaced planes and with their conductors forming contacts thereat, and which are effectively routed so the rear end portions of their conductors are terminated to a single row of terminals. The rear end portions of the flat flexible circuits lie in a stack on a circuit board or other second device, with the conductors of the two circuits being staggered and having parts that are devoid of insulation. The circuit conductors are soldered to circuit board traces, with at least the conductors of the upper circuit of the stack being downwardly deformed against the circuit board traces.

The cables have middles that extend away from the circuit board. In a plug connector whose housing has a central beam, both circuits remain stacked in extension along a first side of the beam, with only the second circuit extending along a second opposite side of the beam. In a receptacle connector wherein the connector housing includes first and second largely parallel beams, the middles of the circuits have lower portions that remain stacked and upper portions which are separated, and the circuits have front portions that each extends along a different beam.

The novel features of the invention are set forth with particularity in the appended claims. The invention will be best understood from the following description when read in conjunction with the accompanying drawings.

BRIEF DESCRIPTION OF THE DRAWINGS

FIG. 5 is an enlarged sectional view of the flat flexible circuits of the connector assembly of FIG. 2.

FIG. 6 is a partial isometric view of the assembly of FIG. 5.

FIG. 7 is a plan view of the assembly of FIG. 6.

DESCRIPTION OF THE PREFERRED EMBODIMENT

Figure 1:
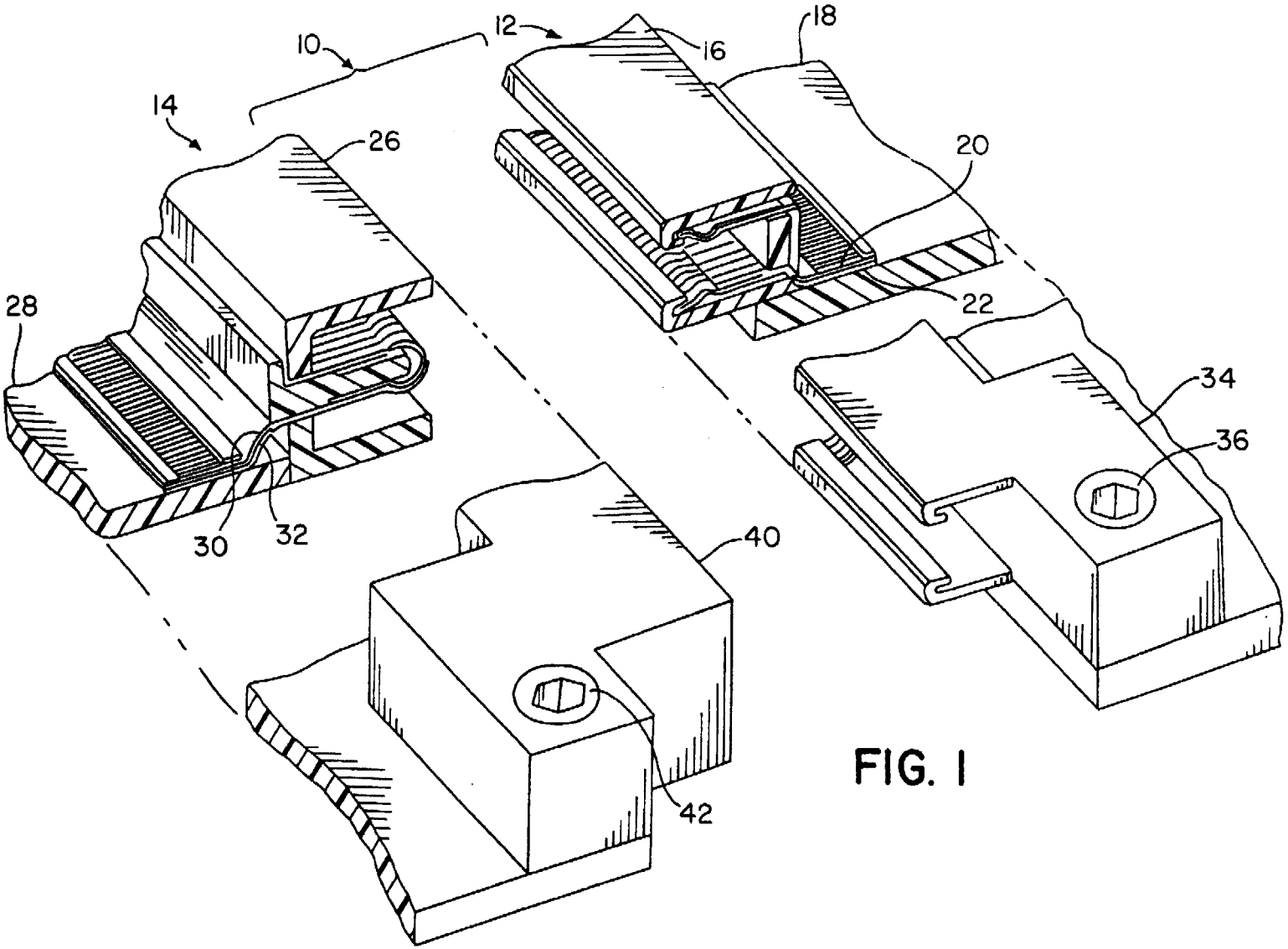
FIG. 1 is a partial exploded isometric view of a pair of mating connector assemblies of the present invention.

FIG. 1 illustrates connection apparatus 10 which include a receptacle connector assembly 12 and a plug connector assembly 14, which can mate. The receptacle connector assembly 12 includes a receptacle connector 16, a second device in the form of a circuit board 18, and first and second flat flexible circuits 20, 22. The plug connector assembly 14 includes a plug connector 26, a second device in the form of a circuit board 28, and a two layer flat flexible circuit 30, 32. The receptacle connector 16 has ends such as 34 that are connected by fasteners such as screws 36 to the circuit board. The opposite ends of the plug connector 26 similarly has opposite ends 40 connected by screws 42 to the circuit board.

Figure 2:
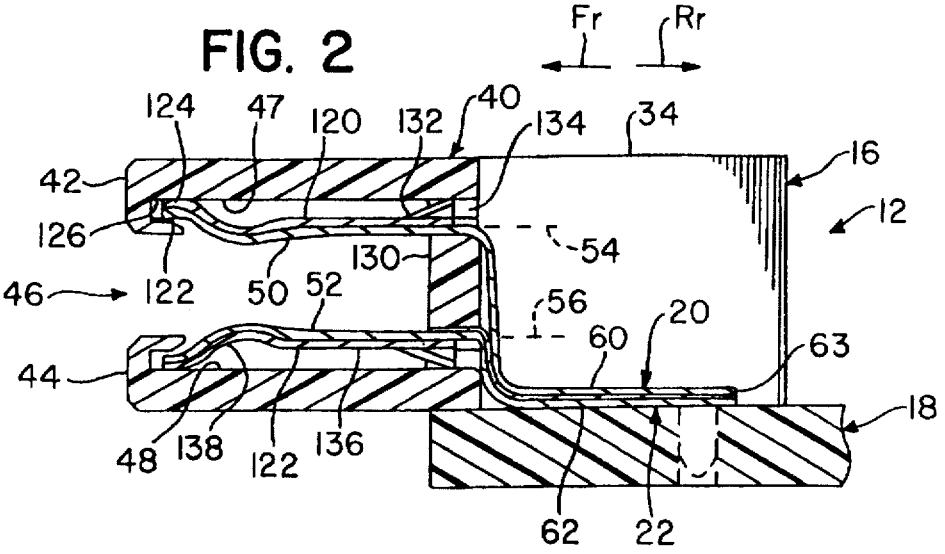
FIG. 2 is a sectional side view of the receptacle connector assembly of FIG. 1.

As shown in FIG. 2, the receptacle connector 16 has a housing 40 with first and second, or upper and lower beams 42, 44, which have facing sides 47, 48 and which form a plug-receiving space 46 between them. The first or upper flat flexible circuit 20 has a front end portion 50 lying under the upper beam and mounted thereon, while the second circuit 22 has a front end portion 52 lying above the lower beam 44 and mounted thereon. Thus, the front end portions of the circuits lie largely in spaced parallel planes 54, 56. Each of the circuits has a rear end portion 60, 62 lying in a bonded stack 63, with the rear end portion 62 of the second circuit sandwiched between the circuit board 18 and the rear end portion 60 of the first circuit. FIG. 2 shows forward and rearward directions Fr, Rr relative to the receptacle connector 16. Of course, the receptacle connector can have its plug-receiving space 46 facing vertically instead of horizontally.

As shown in FIG. 6, each flat flexible circuit is similar to a flat flexible cable, in that the flat flexible circuit includes a plurality of elongated and primarily parallel conductors, with the first or upper circuit 20 having a plurality of elongated and primarily parallel first conductors 64 that are mounted on a layer 66 of insulation. The conductors and insulation are preferably flexible to bend during construction, with their front portions being flexible after construction to serve as contacts. A variety of techniques are available to hold the conductors to the layer of insulation, such as by using a film of adhesive between them. The second or lower flat flexible circuit 22 is similarly constructed, with a plurality of substantially parallel second conductors 70 held together by a second layer of insulation 72. The terms "upper" and "lower" flat flexible circuits refers to their relative positions on the circuit board. It may be noted that a spacer 74 of insulative (dielectric) material lies between the rear end portions of the two circuits.

As shown in FIG. 7, which shows rear end portions 60, 62 of the flat flexible circuits, the first conductors 64 of the upper circuit are positioned at a pitch, or center-to-center spacing A, which is equal to the spacing of the second conductors 70 of the second circuit. The conductors are staggered along their rear portions, so a second conductor such as 70A lies immediately between two first conductors 64A, 64B as seen in a plan view. This results in a spacing B of the conductors as seen in a plan view. As shown in FIG. 6, the circuit board carries a row of electrically conductive traces 80 at a spacing B equal to the spacing of the two rows of conductors 64, 70. The circuit's are devoid of insulation along a termination length 82 (FIG. 5) of each circuit rear end portion (the spacer 74 is not present along the termination lengths 82). As shown in FIG. 5, each circuit has a stacking part 60A, 60B and 62A, 62B at opposite ends of the termination lengths. The first and second conductors 64, 70 are terminated to the circuit board traces 80 by deflecting the conductors downwardly, as with bar 90, against the traces and soldering the conductors to the traces. Applicant prefers to coat each of the traces 80 with a layer of solder and use a hot bar 90 which, when it presses the conductors against the solder pads on the traces 80, melts the solder to solder the conductors to the traces. In connectors that applicant has designed, each conductor had a width C of 8 mils (one mil equals one thousandth inch), and a conductor pitch A of 25 mils in each circuit. The circuit board traces were spaced apart by a distance B of 12.5 mils.

As shown in FIG. 5, the flat flexible circuits have middles 100, 102 extending away from the circuit board, with lower middle parts 104, 106 of the circuit middles being curved. Upper middle parts 110, 112 of the circuits are curved at different heights, so the front end portion 52 of the second circuit peels away from the first circuit and extends horizontally, and with the front end portion 50 of the first circuit bent horizontally at a higher level. The spacer 74 terminates a short distance beyond where the circuits separate. The spacer lies between exposed faces 114, 115 of the circuits, along parts of the circuit rear end portions and middles. The spacer prevents the exposed faces of the conductors 64, 70 of the two circuits, from touching each other if the circuits should shift slightly, or where the front end portions of the conductors of the two circuits are not staggered. The insulative layer of each circuit lies at the nonexposed face 116, 117 of the corresponding circuit. Locations 118, 119 on the exposed faces of the conductors along the circuit front portions, serve as contact mating portions that engage contacts of a mating connector.

Figure 4:
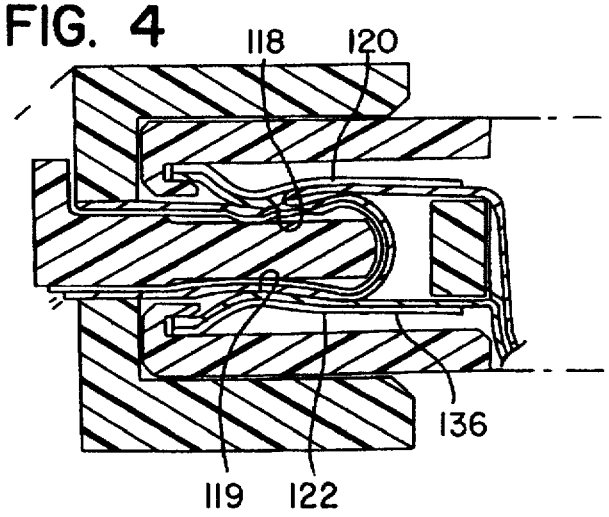
FIG. 4 is a partial sectional view of the connector assemblies of FIGS. 2 and 3 shown mated.
Figure 9:
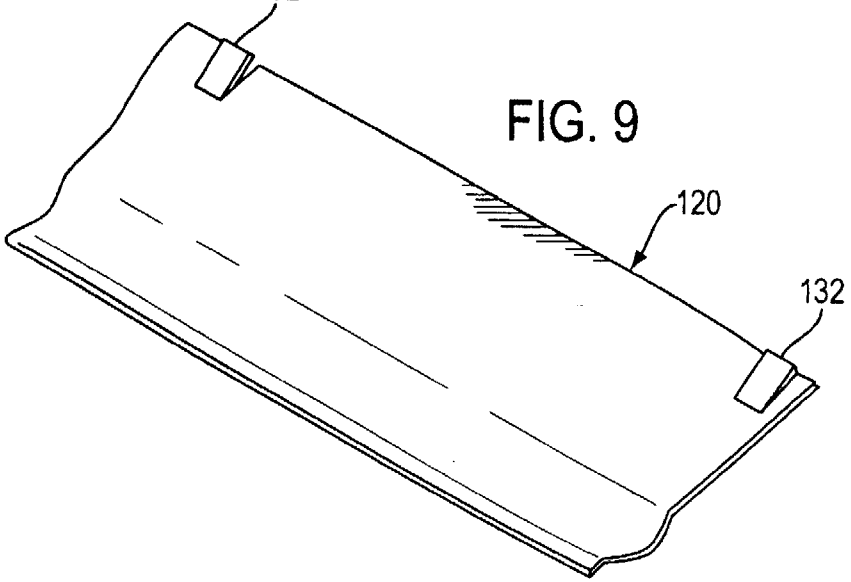
FIG. 9 is a partial isometric view of one of the springs of the receptacle connector of FIG. 2.

As shown in FIG. 2, applicant provides a sheet metal spring 120, 122 between each beam 42, 44 and the front end portion 50, 52 of a corresponding circuit that is mounted on the beam. The circuits and beams lie substantially facewise against each other. The circuits and springs have front tips 122, 124 that are captured in a corresponding groove 126 of a beam, with the groove facing in the rearward direction Rr. The rear end of the spring lies between a corresponding beam such as 42 and a housing column 130. The spring has a few upstanding tabs 132 that engage a stop 134 that prevents loss of the spring. FIG. 9 shows that the tabs 132 are widely spaced. Referring again to FIG. 2, it can be seen that each spring such as 122 has a straight inner portion 136 that extends along at least half of the length of the spring, as seen in the sectional view of FIG. 2. The straight portion 136 is spaced from the corresponding beam to permit the spring and corresponding circuits to be deflected towards the beam. Each spring has an outer portion 138 that is bowed towards the other spring. FIG. 4 shows the two connectors mated, with the springs 120, 122 having their straight portions 136 deflected towards corresponding beams on which the springs are mounted.

Figure 3:
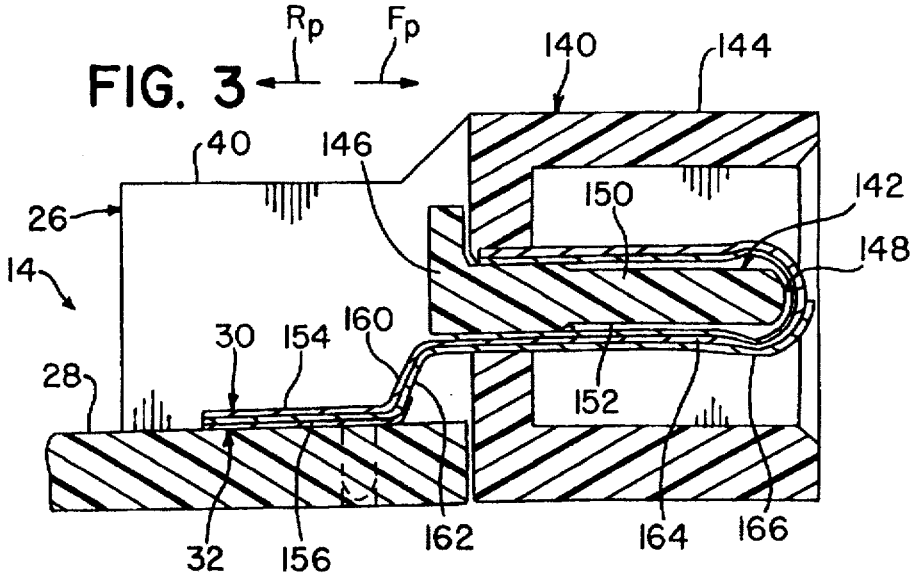
FIG. 3 is a sectional view of the plug connector assembly .of FIG. 1.

FIG. 3 shows the plug connector 26 whose housing 140 includes a plug beam 142 lying within a receptacle-receiving enclosure 144 of the housing. The plug beam 142 has a rear or inner end 146 mounted on the enclosure portion 144 of the housing, a forward free beam end 148, and first and second opposite sides 150, 152. The flat flexible circuits 30, 32 have first or rear end portions 154, 156 that are stacked on the circuit board 28 and that are connected to traces on the circuit board, have middles 160, 162 that extend away from the circuit board, and have forward end portions 164, 166 that lie adjacent to the plug beam 142. FIG. 3 shows forward and rearward directions Fp, Rp relative to the plug connector 26.

Figure 8:
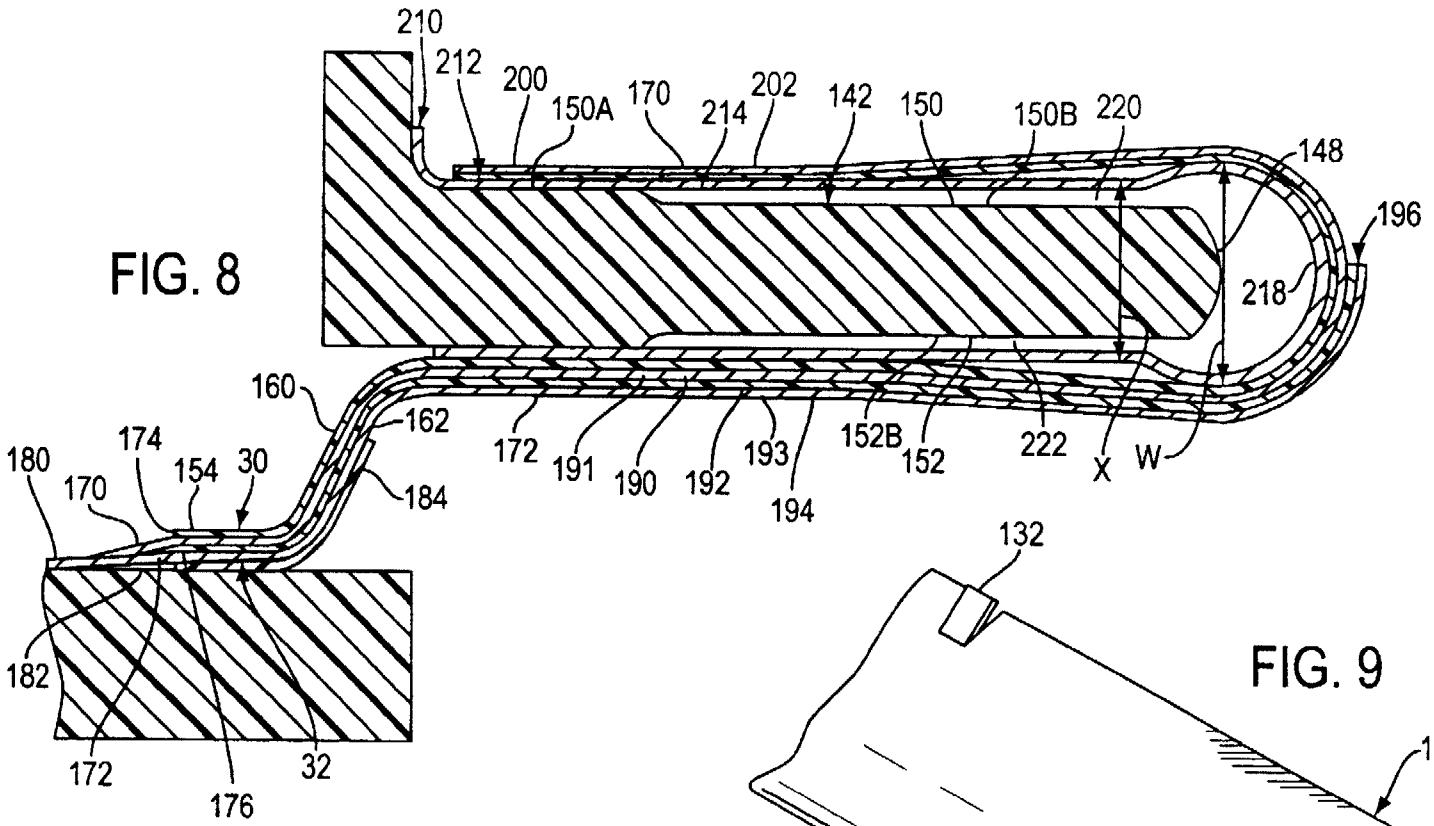
FIG. 8 is an enlarged view of a portion of the plug connector of FIG. 3.

As shown in FIG. 8, the first and second flat flexible circuits 30, 32 each has a row of elongated conductors 170, 172 and a layer of insulation 174, 176. The rear end portions of the circuits form termination lengths 180 where the conductors are exposed and soldered to circuit board conductive traces 182 in the same manner as shown in FIGS. 5–7 for the receptacle connector. One exception is that a spacer 184 is provided which lies under the second circuit, and which is used to separate the conductors of the second circuit from the circuit board to prevent the second conductors from touching any traces on the circuit board.

The circuits 30, 32 have forward end portions 190, 192 that are stacked on the lower or second face 152 of the plug beam, that is, they lie in a stack near the beam face 152. The conductors 172 of the second beam have exposed faces 194 along the portions that extend along the second face 152 of the plug beam, to form contacts therealong. The second circuit has an end at 196 which is short of the second face 150 of the plug beam.

The front portion 190 of the first circuit has a region 191 that is sandwiched between the region 193 of the second circuit front portion 192 and the beam second face 152, but extends around the free end 148 of the plug beam and along its first face 150. The region 200 of the second circuit front portion which lies along the first face 150 of the plug beam, has its conductors 170 positioned so their faces 202 are exposed and form contacts.

The plug connector includes a spring 210 with a spring region 212 that is of largely U-shape and that lies between the circuits and the plug beam 142. The spring region includes first and second parallel spring legs 214, 216 extending on opposite sides of the plug beam along the first and second beam faces, and a spring base 218 that extends around the beam free end 148. The plug beam faces have inner portions 150A, 152A, with the spring legs 214, 216 pressed thereagainst. The beam faces have outer portions 150B, 152B that are recessed from imaginary extensions of the inner portions. The spring legs 214, 216 are spaced from the beam face outer portions 150B, 152B. This allows the circuits and spring legs to deflect into the spaces 220, 222 when mating to the receptacle connector. The spring base 218 has a greater outside width W than the distance X between the outside of the parallel legs. This results in a slight separation of the circuits and spring legs for increased deflection.

As described above, applicant constructs the connector assemblies, as shown in FIGS. 5 and 8, so each has a pair of flat flexible circuits that are stacked on the circuit board and with their conductors staggered and soldered or otherwise fastened to a single row of circuit board traces. This construction has the advantage of taking up only a small amount of space on the circuit board and permitting termination of all conductors in a single operation. The positioning of the circuits so that in the receptacle connector (FIG. 5) the middle portions of the circuits peel away from each other to extend in vertically spaced parallel planes, enables the use of short circuits with relatively short middle portions to extend from the circuit board to the heights of the two rows of contacts at the front portions of the circuits. The construction of the plug connector (FIG. 8), where the circuits lie stacked on one side of the plug beam and only one of the circuits is wrapped to extend along the opposite face of the beam, results in secure mounting and stabilization of the positions of the forward portions of the circuits. Instead of stacking both circuits in a stack along the lower face of the beam, it would be possible to separate them and have each extend along only one face of the beam, in a manner similar to that for the receptacle connector. However, such earlier separation of the circuits would result in them not being as securely or firmly held in position.

While terms such as "upper", "lower", etc. are used in the description of the invention as shown, it should be understood that the connector assemblies can be used in any orientation with respect to Earth's gravity.

Thus, the invention provides connector assemblies and methods for their construction, which results in compact and rugged constructions. Two spaced rows of contacts formed by conductors of flat flexible circuits, are terminated to a circuit board or other second device by stacking the circuits on the circuit board, but with a termination length of the circuits being devoid of insulation and with the conductors thereat being pressed against traces on the circuit board and soldered thereto. In one connector such as the receptacle connector, the second circuit is peeled away from the first one so their front portions extend in spaced largely parallel planes. In another connector construction such as used for the plug connector, the two circuits are stacked on one side of a plug beam, with only one of the circuits being wrapped around and extending along the other face of the plug beam.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector assembly which includes a connector and a second device coupled to said connector, wherein:

said connector includes upper and lower flat flexible circuits each having a plurality of elongated primarily parallel conductors and a layer of insulation that holds said conductors together, each of said circuits having front and rear end portions, said front end portions of said circuits lying in spaced largely parallel planes with said conductors exposed thereat;

said rear end portions of said circuits have regions lying facewise adjacent to each other in a stack, and with said conductors terminated thereat to said second device.

2. The assembly described in claim 1 wherein:

said conductors of each of said circuits are spaced apart at a predetermined pitch at said rear end portions of said circuits;

said second device comprises a circuit board having an upper face and a row of conductive traces on said upper face, with the pitch of said traces being half of said predetermined pitch;

said rear ends of said circuits are positioned so the conductors of said upper and lower circuits are staggered, with a conductor of said upper circuit lying about halfway between two conductors of said lower circuit as seen in a plan view, with at least the conductors of said upper circuit being downwardly deflected against said traces, and with each of said conductors at said circuit rear end portions being soldered to one of said traces.

3. The assembly described in claim 2 wherein:

each of said circuit rear end portions has a termination length which is devoid of insulation, and a pair of stacking parts at opposite ends of the termination length of the circuit, with each of said stacking parts including said layer of insulation.

4. The assembly described in claim 1 wherein:

said connector includes a housing with a receptacle housing portion having upper and lower beams and a plug-receiving space between said beams, said front end portion of said upper circuit lies under said upper beam and is mounted thereon, and said front end portion of said lower circuit lies above said lower beam and is mounted thereon, with lower ends of said conductors of said upper circuit and upper ends of said conductors of said lower circuit being exposed at said front end portions of said circuits.

5. The assembly described in claim 4 including:

upper and lower sheet metal springs, each lying between one of said housing beams and the front end portion of one of said circuits to bias the circuit front end portion into said plug-receiving space;

said beams have rear ends with stops extending substantially into said space between said beams, and said beams have front ends with grooves, and said springs and said circuit front end portions have front ends received in said grooves, and said springs have rear ends with bent tabs therein abutting said stops.

6. The assembly described in claim I wherein:

each of said circuits has a largely vertically extending middle with a lower middle part that merges with the rear end portion of the corresponding circuit and an upper middle part that merges with the front end portion of the corresponding circuit;

said circuits each have exposed and nonexposed circuit faces, with said conductors of each circuit being exposed along the exposed face of the circuit but not along said nonexposed face of the circuit, with said nonexposed circuit faces facing each other along said rear end portions and along said front end portions of said circuits; and including a sheet-like spacer of insulative material which lies between said circuits and engages both of them along at least part of said rear end portions and part of said middles of said circuits.

7. The assembly described in claim 1 wherein:

said connector includes a housing with a plug beam having first and second opposite beam faces and a free beam end, with a first of said circuits having a region extending along only said first beam face but not along said second beam face, and with said conductors of said first circuit being exposed, in a direction away from said beam, along said region thereof which extends along said first beam face;

a second of said circuits extends around said beam free end and along both of said beam faces, with said second circuit having a region lying between said beam first face and said first circuit region, and with said conductors of said second circuit being exposed in a direction away from said beam along the region of said second circuit which extends along said second beam face.

8. The assembly described in claim 7 including:

a spring with a largely U-shaped spring region that includes first and second legs lying respectively between said first and second beam faces and regions of said circuits extending along said faces, said spring region including a base that lies beyond said beam free end and that connects said legs, with said legs extending parallel to each other along more than half of the length of each of said beams and with said base having a length that is less than half the length of either of said legs, said base having a maximum width W that is greater than the distance X between said legs where they extend parallel to each other.

9. The connector described in claim 7 including:

a spring device that has a largely U-shaped spring region that lies between said circuits and said plug beam, said spring region including first and second parallel spring legs extending on opposite sides of said plug beam respectively along said first and second beam sides, and a spring base that extends around said beam free end and that connects said spring legs;

said plug beam has inner and outer ends with said free end lying at said outer end, and said beam opposite sides have beam inner portions with said spring legs pressed thereagainst, and said beam opposite sides have recessed beam outer portions that are each recessed from an imaginary extension of a corresponding beam inner portion, and said spring legs are spaced from said beam side inner portions so they can deflect towards said beam inner portions.

10. A connector assembly comprising:

a circuit board having upper and lower faces and having a row of conductive traces on said upper face;

a connector which includes a housing mounted on said circuit board, said housing having first and second parallel beams with facing sides that face each other;

upper and lower flat flexible circuits, each including a row of conductors and a layer of insulation that holds to said conductors;

said circuits have first portions that are stacked on said upper face of said circuit board with each of said conductors connected to one of said traces and with said lower circuit lying under said upper circuit therealong;

said lower circuit has a second portion that lies on said facing side of said second beam with said conductors of said lower circuit having exposed sides that face toward said first beam, and said upper circuit has a second portion that lies on said facing side of said first beam with said conductors of said upper circuit having exposed sides that face toward said second beam.

11. The connector assembly described in claim 10 wherein:

each of said beams has inner and outer ends, with the space between said beam outer ends being primarily open to receive a portion of a mating connector;

a pair of sheet metal springs, each mounted on one of said beams and lying between the corresponding beam and the second portion of the circuit that is mounted on the beam;

each of said springs having a straight inner portion extending along at least half of the length of the corresponding beam but being spaced from the beam, and having a spring outer portion that is bowed toward the other spring, with said spring outer portions each having an extreme outer end that is captured in the corresponding beam outer end.

12. A connector assembly comprising:

a circuit board having upper and lower faces and having a row of conductive traces on said upper face;

a connector which includes a housing mounted on said circuit board, said housing having a plug beam with first and second opposite sides and a free end;

first and second flat flexible circuits, each including a row of conductors and a layer of insulation that holds to said conductor;

said circuits have first portions that are stacked together on said upper face of said circuit board with each of said conductors connected to one of said traces;

said circuits have second portions that are stacked on said second side of said plug beam, with said first circuit lying closer to said plug beam than said second circuit therealong and with said conductors of said second circuit having exposed sides that face away from said plug beam, and with said first circuit extending around said free end of said plug beam and along said first side of said plug beam and with said conductors of said first circuit having exposed sides that face away from said beam.

13. The connector assembly described in claim 12 including:

a spring that has a largely U-shaped spring region that lies between said circuits and said plug beam, said spring region including first and second parallel spring legs extending on opposite sides of said plug beam respectively along said first and second beam sides, and a spring base that extends around said beam free end and that connects said spring legs;

said plug beam has inner and outer ends with said free end lying at said outer end, and said beam opposite sides have beam inner portions with said spring legs pressed thereagainst, and said beam opposite sides have beam outer portions that lie closer together than said beam inner portions and with each outer beam portions being recessed from an imaginary extension of a corresponding beam inner portion, and said spring legs are spaced from said beam inner portions so said spring legs can deflect towards said beam inner portions.

* * * * *